US011767749B2

(12) United States Patent
Chapman et al.

(10) Patent No.: US 11,767,749 B2
(45) Date of Patent: Sep. 26, 2023

(54) INERTIAL COMPENSATION FOR A QUILL OSCILLATOR

(71) Applicant: Ensign Drilling Inc., Calgary (CA)

(72) Inventors: Jarrod David Chapman, Kingwood, TX (US); Chiranjit Saha, Richmond, TX (US); Sean Timothy Halloran, Denver, CO (US)

(73) Assignee: Ensign Drilling Inc, Calgary (CA)

( * ) Notice: Subject to any disclaimer, the term of this patent is extended or adjusted under 35 U.S.C. 154(b) by 1 day.

(21) Appl. No.: 17/228,951

(22) Filed: Apr. 13, 2021

(65) Prior Publication Data

US 2021/0324725 A1 Oct. 21, 2021

Related U.S. Application Data

(60) Provisional application No. 63/010,239, filed on Apr. 15, 2020.

(51) Int. Cl.

| | |
|---|---|
| ***E21B 44/04*** | (2006.01) |
| ***E21B 47/007*** | (2012.01) |
| ***E21B 3/025*** | (2006.01) |
| ***E21B 3/02*** | (2006.01) |
| ***E21B 7/24*** | (2006.01) |

(52) U.S. Cl.

CPC ..... *E21B 44/04* (2013.01); *E21B 3/022* (2020.05); *E21B 3/025* (2013.01); *E21B 7/24* (2013.01); *E21B 47/007* (2020.05)

(58) Field of Classification Search

CPC ..... E21B 44/04; E21B 3/022; E21B 3/025; E21B 7/24; E21B 47/007; E21B 7/068

See application file for complete search history.

(56) References Cited

U.S. PATENT DOCUMENTS

| | | | | |
|---|---|---|---|---|
| 6,050,348 | A | 4/2000 | Richardson et al. | |
| 6,918,453 | B2 * | 7/2005 | Haci | E21B 7/068 175/26 |
| 7,096,979 | B2 * | 8/2006 | Haci | E21B 44/04 175/45 |
| 7,461,705 | B2 * | 12/2008 | Hulick | E21B 7/24 175/57 |
| 8,387,720 | B1 | 3/2013 | Keast et al. | |
| 8,528,663 | B2 | 9/2013 | Boone | |
| 8,672,055 | B2 | 3/2014 | Boone et al. | |
| 9,080,428 | B1 | 7/2015 | Rembach et al. | |
| 9,290,995 | B2 * | 3/2016 | Boone | E21B 7/24 |
| 9,624,762 | B2 | 4/2017 | Kyllingstad | |

(Continued)

FOREIGN PATENT DOCUMENTS

| | | |
|---|---|---|
| CA | 2600600 | 5/2011 |

*Primary Examiner* — Jonathan Malikasim

(74) *Attorney, Agent, or Firm* — Armstrong Teasdale LLP

(57) ABSTRACT

A drilling system configured to reduce friction during slide drilling. The drilling system has a drill string comprising a fluid-driven drill stage such as a mud motor; a variable frequency drive configured to oscillate the drill string via a quill and a sensor array. The sensor array measures the torque applied to the quill and the angular position of the quill. A controller is used to control the variable frequency drive based on the determined applied torque and quill angular position to meet predetermined oscillation turn-around criteria and to reduce the time to reduce the angular velocity of the quill from a maximum rotational speed to zero in an oscillation cycle.

20 Claims, 6 Drawing Sheets

(56) References Cited

U.S. PATENT DOCUMENTS

| | | | | |
|---|---|---|---|---|
| 9,650,880 | B2 * | 5/2017 | Bowley | E21B 3/02 |
| 9,784,035 | B2 | 10/2017 | Boone et al. | |
| 9,948,216 | B2 * | 4/2018 | Blackwelder | H02P 9/009 |
| 10,094,209 | B2 * | 10/2018 | Gillan | E21B 7/067 |
| 10,233,740 | B2 * | 3/2019 | Patterson | E21B 3/02 |
| 2013/0084138 | A1 * | 4/2013 | Kerr | B65G 53/60 406/10 |
| 2016/0341027 | A1 | 11/2016 | Kyllingstad | |
| 2017/0183953 | A1 | 6/2017 | Harris et al. | |
| 2017/0243383 | A1 | 8/2017 | Gillan et al. | |
| 2018/0038215 | A1 | 2/2018 | Badkoubeh et al. | |
| 2018/0128093 | A1 | 5/2018 | Jeffryes et al. | |
| 2018/0258750 | A1 | 9/2018 | Hadi et al. | |
| 2018/0283156 | A1 | 10/2018 | Viens | |
| 2018/0347281 | A1 | 12/2018 | Duplantis et al. | |
| 2019/0048707 | A1 | 2/2019 | Benson et al. | |
| 2019/0106979 | A1 | 4/2019 | Hadi et al. | |
| 2020/0024901 | A1 * | 1/2020 | Shor | E21B 44/04 |
| 2021/0095555 | A1 * | 4/2021 | Wu | E21B 43/16 |
| 2021/0348494 | A1 * | 11/2021 | Pabon | E21B 44/04 |

* cited by examiner

INERTIAL COMPENSATION FOR A QUILL OSCILLATOR

RELATED APPLICATIONS

This application claims priority from U.S. Provisional Application No. 63/010,239, filed on Apr. 15, 2020, which is hereby incorporated by reference in its entirety.

FIELD OF THE INVENTION

The invention relates to directional drilling, systems for reducing friction in a drill string during slide drilling, and in particular to optimizing torsional oscillations of a drill string.

BACKGROUND

Drilling directional wells with modern alternating current (AC) drilling rigs can require a complex understanding of drill string dynamics, downhole conditions and rig capabilities. It is common for a driller to manufacture a wellbore both with rotational drilling, where the entire drill string is rotated by means of an AC Top Drive, or slide drilling, where the drill string is not continuously rotated but drilling fluid pumped down the drill string causes a drill bit at the end of a 'mud motor' to rotate in order to effect the drilling process. The forward motion of the drill bit through the rock is then accomplished by placing weight on the drill string and allowing it to slide down the hole. This type of slide drilling is often implemented with a mud motor that has a bent shaft, allowing the wellbore to curve along a predetermined path. The ability to maintain this 'toolface' while sliding is then critical to staying on the well path, as any rotation at the motor will cause the wellbore to curve along a different path.

The rotation of the bit at the end of the mud motor will generate a certain amount of 'reactive torque' in the drill string, which will cause the toolface to rotate in the opposite direction. By building in some amount of torque to offset this reactive torque, a constant toolface can be maintained.

Using slide as opposed to rotational drilling will cause the drill string to encounter an increased amount of friction in the wellbore. By rotating first in one direction and then another at the surface by oscillating the Top Drive, the friction the drill string encounters may be reduced, thus delivering more weight to the bit for more efficient drilling. A challenge is to use the drill string's inherent spring-like properties to only twist the drill string along that length of drill string from the Top Drive to just behind the mud motor so that the mud motor itself remains stationary, such that the toolface is maintained, while at the same time we are reducing friction along the rest of the drill string by through the oscillations.

U.S. Pat. No. 7,461,705 B2 discloses a method for oscillating a drill string, the drill string extending into the earth, the drill string having a bit on a lower end thereof, the bit for drilling into the earth, the drill string connected to a motive apparatus, the motive apparatus for rotating the drill string, the motive apparatus having a power output associated with rotating the drill string, the method including, in certain aspects, determining a first amount of energy and a second amount of energy, said determining based on the power output of the motive apparatus, applying the first amount of energy to the drill string in a first rotational direction, applying the second amount of energy to the drilling in a second rotational direction, the second rotational direction opposite to the first rotational direction, the application of both the first amount of energy and the second amount of energy not moving the bit.

SUMMARY

In accordance with the invention, there is provided a drilling system for oscillating a drill string having a fluid-driven drill stage, the drilling system comprising:

a variable frequency drive configured to oscillate the drill string via a quill;

a sensor array having a torque sensor configured to determine a measure of torque applied to the quill;

a controller configured to receive information from the sensor array and to determine the angular position and speed of the quill and the inertia applied to the quill by the drill string, wherein the controller is configured to enable ongoing control of the variable frequency drive while decreasing the angular velocity of the quill from a maximum rotational speed to zero in an oscillation cycle, the ongoing control being based on the determined applied inertia and the angular position and speed of the quill and being configured to meet predetermined oscillation turn-around criteria.

The fluid-flow driven drill stage may comprise a mud motor.

The sensor array may comprise an angular position sensor configured to measure the angular position of the quill.

The oscillation turn-around criteria may comprise an angular position at which the quill stops rotating in one direction and starts rotating in the opposite direction.

The oscillation turn-around criteria may comprise a torque at which the quill stops rotating in one direction and starts rotating in the opposite direction.

The controller may be configured to enable control of the variable frequency drive based on the received information and on previous behaviour of the system to meet predetermined oscillation turn-around criteria.

The controller may be to meet an angular-position oscillation turn-around criteria to within plus or minus 1 degree. The controller may be to meet an angular-position oscillation turn-around criteria to within plus or minus 3 degree. The controller may be to meet an angular-position oscillation turn-around criteria to within plus or minus 5 degrees.

The controller may be configured such that, when the turn-around criteria are met, the bit maintains a constant toolface angle.

The controller may be configured to initiate slow-down based on the measured speed of the quill, the measured inertia and the rotational position of the quill.

To reduce the time to decrease the angular velocity of the quill from a maximum rotational speed to zero in an oscillation cycle, The controller may be configured to continuously control the torque being applied to the quill by the variable frequency drive to follow a target glide path, the target glide path being configured to meet the predetermined turn-around criteria.

The controller may be configured to continuously control the torque being applied to the quill by the variable frequency drive to follow a target glide path, the target glide path being configured to meet the predetermined turn-around criteria, and wherein the glide path is calculated based on maximum continuous torque curve of the variable frequency drive.

Machine learning may be used to help ensure that the slow down follows the target glide path based on previous slow-down data.

The controller may be configured to allow short-term overload torque to be applied in response to the controller detecting that the quill is not being slowed down sufficiently quickly to meet the turn-around criteria.

The controller may be configured to allow less than a maximum continuous torque to be applied in response to the controller detecting that the quill is being slowed down too quickly to meet the turn-around criteria.

The controller may be configured to prevent short-term overload torque being used for more than a threshold period of time within an oscillation cycle.

The controller may be configured to stop rotation if a threshold inertia is measured regardless of whether the turn-around criteria is met.

The variable frequency drive may have a rotation-speed dependent maximum continuous torque.

The torque on the quill may be exerted by the drill string.

According to a further aspect, there is provided a method of controlling a drilling system, the drilling system comprising:

a drill string comprising a fluid-driven drill stage;

a variable frequency drive configured to oscillate the drill string via a quill;

a sensor array having a torque sensor configured to determine a measure of torque applied to the quill by the variable frequency drive;

a controller configured to receive information from the sensor array and to determine the applied torque, and the angular position and the angular speed of the quill, wherein the method comprises:

controlling the variable frequency drive on an ongoing basis while decreasing the angular velocity of the quill from a maximum rotational speed to zero in an oscillation cycle, the ongoing control being based on the determined applied inertia and the angular position and speed of the quill and being configured to meet predetermined oscillation turn-around criteria The system may be configured to control the variable frequency drive based on applied torque, and the angular position and the angular speed of the quill to meet predetermined oscillation turn-around criteria and to reduce the time to decrease the angular velocity of the quill from a maximum rotational speed to zero in an oscillation cycle.

The system may be configured to store a torque curve for the variable frequency drive providing the relationship between the maximum continuous torque available as a function of rotation speed (e.g. measured in rpm).

The system may be configured to monitor whether the torque provided by the variable frequency drive is: above the torque curve (i.e. corresponding to short-term overload torque); below the torque curve; and/or on the torque curve (e.g. within a predetermined threshold such as within 5% of the maximum continuous torque value for the rotation speed). This may help determine whether the glide path is an efficient way of achieving the turn-around criteria quickly without damaging the variable frequency drive.

The system may be configured to store a representation of the speed vs torque curve. The representation of the torque curve may be stored as a polynomial or as a lookup table (e.g. where the actual value to be used is determined directly from the look-up table or by using a linear approximation between two points in the look-up table).

The system may be configured to use the torque curve to maximum allowable velocity base on total torque available. If the user demands the velocity higher than the allowable velocity, system may be configured to use the maximum allowable velocity as motor velocity limit.

When the system is configured to use turn-around criteria defined by torque, the system may be use equations to compute the degree needed to reach the torque limit:

$$J = \frac{\pi}{32}\left(D_o^4 - D_i^4\right) * L * G$$

$$\omega = \frac{T}{J}\frac{\pi}{30}$$

$$\Theta = \frac{T}{L * G}\frac{180}{\pi}$$

where:

G: Drill String Density (typical value 7850)

$$\left[\frac{Kg}{m^3}\right]$$

T: Torque Limit [Nm]

D: Drill pipe diameters [m]

L: Bit depth [m]

J: Drill string Inertia [$kgm^2$]

Θ: angle of twist [Degree]

ω: Motor acceleration Limit [RPM]

A topdrive may be considered to be a device that turns the drill string. It consists of one or more motors (electric or hydraulic) connected with appropriate gearing to a short section of pipe called a quill, that in turn may be screwed into a saver sub or the drill string itself. The topdrive is typically suspended from the hook, so the rotary mechanism is free to travel up and down the derrick.

A crown block refers to a fixed set of pulleys (or sheaves) located at the top of the derrick or mast, over which the drilling line is threaded. The companion blocks to these pulleys are the traveling blocks which are the set of sheaves that move up and down in the derrick. The wire rope threaded through them is threaded (or "reeved") back to the stationary crown blocks located on the top of the derrick.

A derrick is the structure used to support the crown blocks and the drill string of a drilling rig. Derricks are usually pyramidal in shape to offer a good strength-to-weight ratio.

Slide drilling may use a mud motor to rotate the bit downhole without rotating the drill string from the surface. This operation may be conducted when the bottomhole assembly has been fitted with a bent sub or a bent housing mud motor, or both, for directional drilling. Slide drilling is a method to build and control or correct hole angle in directional drilling operations. Directional drilling involves orienting the bit in the desired direction using the bent sub, which has a small angle offset from the axis of the drill string.

A mud motor may be a positive displacement drilling motor that uses hydraulic power of the drilling fluid to drive the drill bit. Mud motors are used extensively in directional drilling operations.

The toolface is the angle measured in a plane perpendicular to the drill string axis that is between a reference direction on the drill string and a fixed reference. For near-vertical wells, north may be used as the fixed reference and the angle is the magnetic toolface. For more-deviated wells, the top of the borehole is the fixed reference and the angle is the gravity toolface, or high side toolface.

Torque may be considered to be the product of the moment of inertia and the angular acceleration.

An oscillation period is the time taken for the system to return to an equivalent state within the oscillation. An oscillation period may comprise two oscillation cycles: a clockwise oscillation cycle and a counter-clockwise oscillation cycle.

Ongoing control may be achieved by continuously monitoring the applied torque, and the angular position and the angular speed of the quill, and adjusting the variable frequency drive accordingly.

Ongoing control may be achieved by frequently and/or regularly monitoring the applied torque, and the angular position and the angular speed of the quill, and adjusting the variable frequency drive accordingly. The monitoring frequency may be at least 10 times per second. In this embodiment, the plc scan time may be 25 ms; thus, the monitoring frequency is 40 times per second. In other embodiments the monitoring frequency may be greater than 40 times per second and/or less than 1000 times per second.

The controller may comprise a proportional-integral-derivative controller (PID controller or three-term controller). A PID controller is a control loop mechanism employing feedback that is widely used in industrial control systems and a variety of other applications requiring continuously modulated control. A PID controller continuously calculates an error value as the difference between a desired setpoint (SP) and a measured process variable (PV) and applies a correction based on proportional, integral, and derivative terms (denoted P, I, and D respectively).

The controller may comprise a proportional-derivative controller (PD) controller. It will be appreciated that, in the context of this disclosure, a PID controller is a type of PD controller. The controller may comprise a Fuzzy-PID controller. The controller may comprise a Fuzzy-PD controller.

The present system may be configured to calculate the angular position from the motor rpm reported by the variable frequency drive. This encoder-less (angle-position-sensor-less) design, where the angular position is calculated from the motor rpm reported by variable frequency drive, means that maintenance for the encoder may be eliminated. Such maintenance can lead to many hours of downtime on each fault. In some embodiments using encoder feedback may be provided as a second option to calculate quill position but the quill oscillator can run 100% independent of that.

The torque on the quill may also be indirectly determined or calculated from the current consumed by the motor which is reported by variable frequency drive. In such embodiments, no actual torque sensor may be present on the top drive to measure quill torque. That is the sensor configured to determine a measure of torque may be configured to measure torque directly (i.e. a direct torque sensor) or indirectly (e.g. an indirect torque sensor configured to directly measure motor current).

The torque on the quill may be exerted by the variable frequency drive.

BRIEF DESCRIPTION OF THE DRAWINGS

Various objects, features and advantages of the invention will be apparent from the following description of particular embodiments of the invention, as illustrated in the accompanying drawings. The drawings are not necessarily to scale, emphasis instead being placed upon illustrating the principles of various embodiments of the invention. Similar reference numerals indicate similar components.

DETAILED DESCRIPTION

Introduction

The inventors have recognized a need for a robust method for accurately and quickly ramping down the top drive rotation during oscillating motion to a stopping or turn-around point that is within ±5 degrees from the desired stopping point, so that the wellbore is constructed with a minimum of tortuosity. This smoother wellbore is known to produce a better completed well. The problem is that the Top Drive will encounter varying amounts of inertia as it rotates first one direction, then the other direction. In order to accurately and consistently stop the rotation at the desired angular degree setpoint, the control algorithm will need to adaptively account for a changing inertia. Regular Top Drive controls can achieve ±(15-45) degrees of accuracy, depending on the inertial contribution. Current methods involve slowing down and creeping around the setpoint until it is reached, resulting in an inefficient oscillation that incurs more time in a stationary position.

The method operates on a wide spectrum of angular velocities and torque with unknown downhole conditions.

The technology relates to a method for compensating for external and internal inertia during quill rotation that results in increased accuracy on final endpoint position while rotating across a range of angular velocities and rotational torque. By employing neural network techniques and/or 'fuzzy logic' to provide an improved quill oscillation process may be delivered that meets the needs of today's complex drilling environment.

Various aspects of the invention will now be described with reference to the figures. For the purposes of illustration, components depicted in the figures are not necessarily drawn to scale. Instead, emphasis is placed on highlighting the various contributions of the components to the functionality of various aspects of the invention. A number of possible alternative features are introduced during the course of this description. It is to be understood that, according to the knowledge and judgment of persons skilled in the art, such alternative features may be substituted in various combinations to arrive at different embodiments of the present invention.

System

Figure 1:
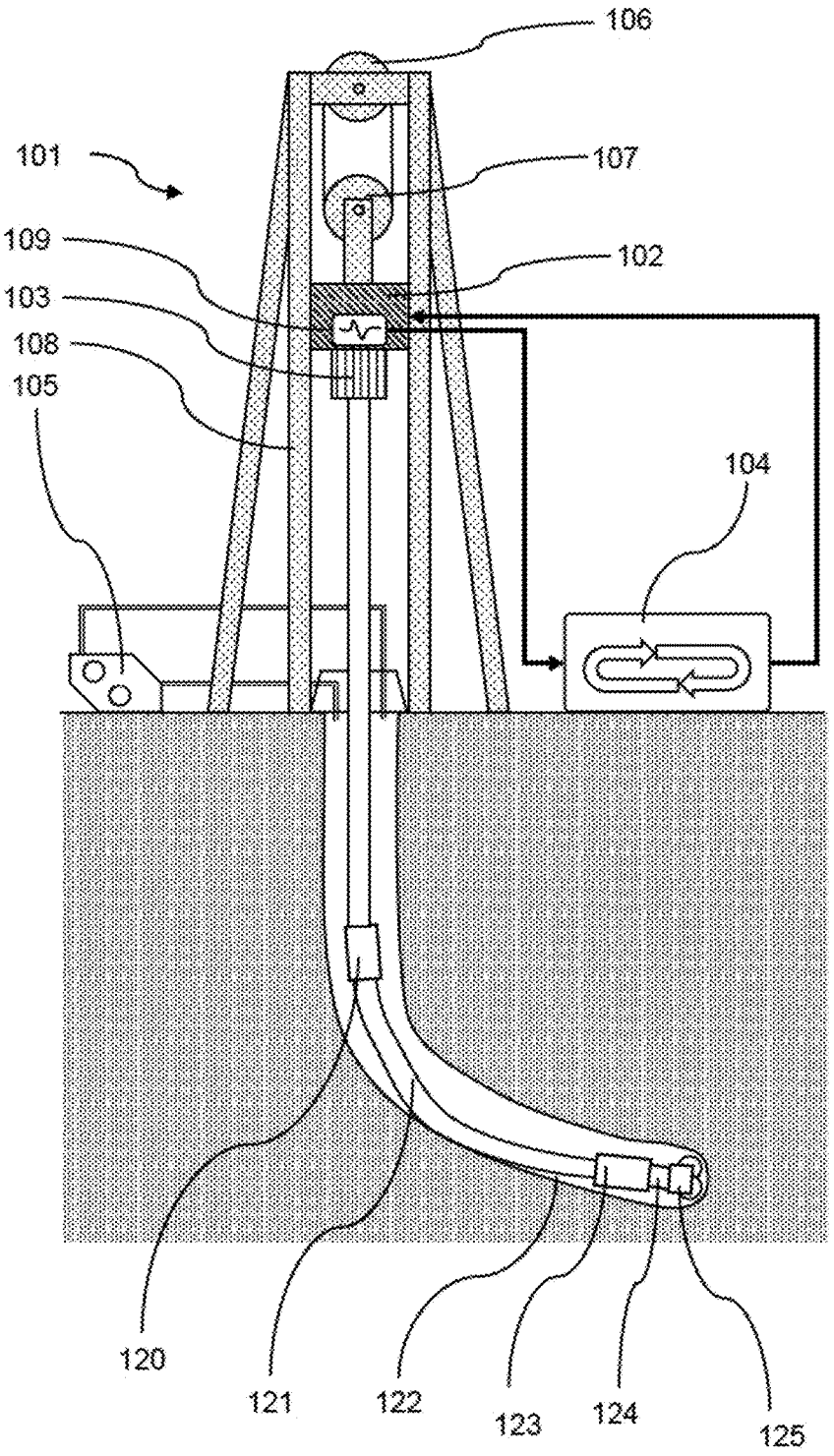
FIG. 1 is a schematic of an embodiment of a drilling system.

FIG. 1 shows a first embodiment of a drilling rig 101. In this case, the drilling rig is a land-based rig, but other rigs (e.g., offshore rigs, jack-up rigs, semisubmersibles, drill ships, and the like) may also be used with the present technology.

In this case, the drilling system 101 comprises:

a drill string 121 comprising a fluid-driven drill stage 123, 124, 125;

a variable frequency drive 102 configured to oscillate the drill string via a quill 103;

a sensor array 109 having:

a sensor configured to determine a measure of torque applied to the quill;

a controller 104 configured to receive information from the sensor array and to determine the applied torque and the angular position of the quill, wherein the controller 104 is configured to enable control of the variable frequency drive 102 based on the determined applied torque and quill angular position to meet predetermined oscillation turn-around criteria and to reduce the time to reduce the angular velocity of the quill from a maximum rotational speed to zero in an oscillation cycle.

The rig includes a derrick 108 that is supported on the ground. The rig includes lifting gear, which includes a crown block mounted to derrick 106 and a travelling block 107. A crown block and a travelling block interconnected by a cable that is driven to control the upward and downward movement of the travelling block. Lowering the travelling block lowers the drill string 121 and can be used to add weight to the drill bit or move the drill string axially into the wellbore as drilling continues. The travelling block may carry a hook which in turn carries the top drive system 102. The top drive 102 comprises a variable frequency drive, configured to rotate the drill string via a quill 103. The top drive 102 can be operated to rotate the drill string in either direction. In some embodiments, the top drive may also be configured to facilitate rotational drilling by continuously rotating in one direction for rotational drilling.

The drill string 121 may be any typical drill string and typically includes one or more of: a section of drill pipe 122, a drill collar 120, and/or a bottom hole assembly (BHA). In this case, the bottom hole assembly comprises a bent shaft 124 with a mud motor 123 and a bit 125. By using a bent shaft 124, the toolface angle of the drill bit is controlled in azimuth and pitch during drilling. That is, if the mud motor is not rotated, wellbore will be drilled to curve along a predetermined path. The ability to maintain this 'toolface' while sliding is then critical to staying on the well path, as any rotation at the motor will cause the wellbore to curve along a different path.

Drilling fluid is delivered to the drill string by a mud pump 105. During sliding drilling, the drill string is held in place by top drive system while the bit is driven by the mud motor, which is supplied with drilling fluid by the mud pump. The driller can operate the top drive system to change the face angle of the bit.

In this way, the system is configured to facilitate directional drilling using slide drilling. In this case, a horizontal well is being drilled. The horizontal well comprises an initial downward portion followed by a lateral portion. When the drilling has progressed into and beyond the horizontal portion, a section of the drill string lies on the bottom of the horizontal portion. This generates significant friction between the bottom of the wellbore and the drill string.

To counteract this friction, the top of the drill string may be oscillated from the surface by the topdrive (i.e. alternately rotated clockwise and anticlockwise). The drill string 121 has some elasticity and behaves like a spring. This means that the amplitude of the torsional oscillation diminishes along the drill string's length. The oscillation amplitude is largest at the top drive and is smallest towards the mud motor and drill bit.

In many circumstances, the aim is to maximize the amplitude of rotation at the topdrive or quill while ensuring that the amplitude of the oscillation diminishes to zero at the mud motor and drill bit (e.g. or within a predetermined range, such as 0±1°). Increasing the amplitude of oscillation at the top drive increases the oscillation amplitude along the drill string and increases the reduction of friction allowing greater force to be applied to the drill bit.

If a lower amplitude oscillation is applied at the top drive 102, then the oscillation amplitude may diminish to zero before the mud motor meaning that there would still be a portion of the drill string experiencing static friction from the wellbore. Conversely, if a larger oscillation amplitude is applied by the top drive, then the mud motor may experience a non-zero oscillation amplitude which would cause the toolface of the drillbit to change, taking the drill string off course.

Various schemes to calculate the amplitude of the drillbit oscillation are known. For example, the drill string may be modelled based on its inertia and the properties of the top drive. Other systems use downhole sensors to measure if the drillbit and/or mud motor are being oscillated by the oscillation of the top drive. The top drive oscillation amplitude is then adjusted accordingly to maximize the oscillation amplitude at surface while not oscillating the mud motor and drill bit.

The amplitude of the oscillation may be expressed in one or more turn-around criteria which describe when the quill should stop rotating in one direction and start rotating in the opposite direction. It will be appreciated that there may be two sets of turn-around criteria in an oscillation period: one for setting the turn-around point for when the rotation switches from clockwise to anticlockwise; and another for when the rotation switches from anticlockwise to clockwise.

The turn-around criteria may comprise an angular position criterion. For example, the rotation may switch from clockwise to anticlockwise when the quill has rotated 720° clockwise from a reference point (e.g. a centre point) and the rotation may switch from anticlockwise to clockwise when the quill has rotated 480° anticlockwise from the reference point.

The turn-around criteria may use torque limits. For example, the rotation may switch from clockwise to anticlockwise when the quill torque reaches a predetermined set value when rotating in a clockwise direction and the rotation may switch from anticlockwise to clockwise when the quill torque reaches a predetermined set value when rotating in an anticlockwise direction.

In this case, in addition to using turn-around criteria to determine the amplitude of oscillation at the quill, the present technology also is configured to minimize the time period of the oscillation by increasing the speed of the quill rotation at certain points in an oscillation cycle. This is facilitated using a controller 104 configured to enable ongoing control of the variable frequency drive while decreasing the angular velocity of the quill from a maximum rotational speed to zero in an oscillation cycle, the ongoing control being based on the determined applied inertia and the angular position and speed of the quill and being configured to meet predetermined oscillation turn-around criteria.

It will be appreciated that in addition to the turn-around criteria, the system may be constrained not to rotate the quill beyond a predetermined angular-speed threshold value (e.g. between 5 and 150 rpm). Therefore, the present technology may be configured to increase the angular speed of the quill between the predetermined angular-speed threshold value and zero while meeting the turn-around criteria (and optionally between zero and the predetermined angular-speed threshold value for the opposite direction). If the speed during this transition period is too high, the quill may overshoot and induce a larger than planned oscillation in the drill string which may move the mud motor and drill bit toolface. If the speed during this transition period is too low, unnecessary friction between the wellbore and the drill string may remain.

In this case, the sensor array comprises an angular position sensor configured to measure the angular position of the quill. In this case, the sensor is configured to distinguish between $2^{11}$ (2048) equally spaced angular positions. This corresponds with an angular resolution of 0.17°. Other embodiments may have an angular resolution of around 1°.

Other embodiments may be configured to calculate the angular position of the quill based on the torque or voltage applied to the variable frequency drive (e.g. using a Clarke and Park transform). The accuracy of the position measured by a position sensor (e.g. encoder) may be less than or equal to ±0.01°. The accuracy of the position measured based on the torque or voltage applied to the variable frequency drive may be less than or equal to ±0.5°.

Controller

In this case, the controller 104 is configured to interact with the variable frequency drive. It is configured to receive sensor data from the variable frequency drive, and to control the variable frequency drive based on this received data. In this embodiment, the only data used by the controller to control the variable frequency drive is from the variable frequency drive.

In this case, the controller 104 uses fuzzy logic and/or machine learning to determine the best configuration of the system in order to satisfy the turn-around criteria (e.g. calculated to provide the greatest degree of rotation of the quill while not rotating the drill bit).

Fuzzy logic is a form of many-valued logic in which the truth values of variables may be any real number between 0 and 1 both inclusive. It is employed to handle the concept of partial truth, where the truth value may range between completely true and completely false.

Machine learning algorithms may be configured to build a mathematical model of sample data, known as "training data", in order to make predictions or decisions without being explicitly programmed to perform the task. It will be appreciated that operational data may also be used as training data. Training data for our purposes can also be generated from mathematical models and/or generated from existing data.

In this case, as the quill is moving, a target turn-around criteria is set. For example, in this case, the turn-around criteria comprise a particular rotational position at which the quill stops rotating one direction and starts rotating in the opposite direction. As the quill rotates at a maximum value of rpm, the controller decides, based on the rotational speed and the torque applied on the quill (or variable frequency drive), when the slow-down should be initiated. The controller is configured to determine a target glide path which provides an efficient way of reducing the speed of the quill from its current speed to zero while meeting the turn-around criteria.

A target glide path, in this case, provides target angular velocity and/or position values for a series of time values. This may be an analytical function or a series of associated target and time values (which may arbitrarily be adjusted to provide a better oscillation profile).

The target glide path is, in this case, based on the determined inertia applied to the quill during the slow-down. The determined glide path may also be based on the torque curve of the variable frequency drive which is the relationship of the maximum continuous torque which can be applied by the variable frequency drive as a function of rotation speed. Typically, a variable frequency drive will have an almost constant torque profile up until a particular threshold rotation speed, and then there may be a field weakening area above this threshold where the available torque is lower.

In this case, the set point for the turn around angular position is set externally. The set points for the angular speed is updated dynamically during the ramp up and ramp down based on the experienced torque until the angular position set point is met.

Figure 2:
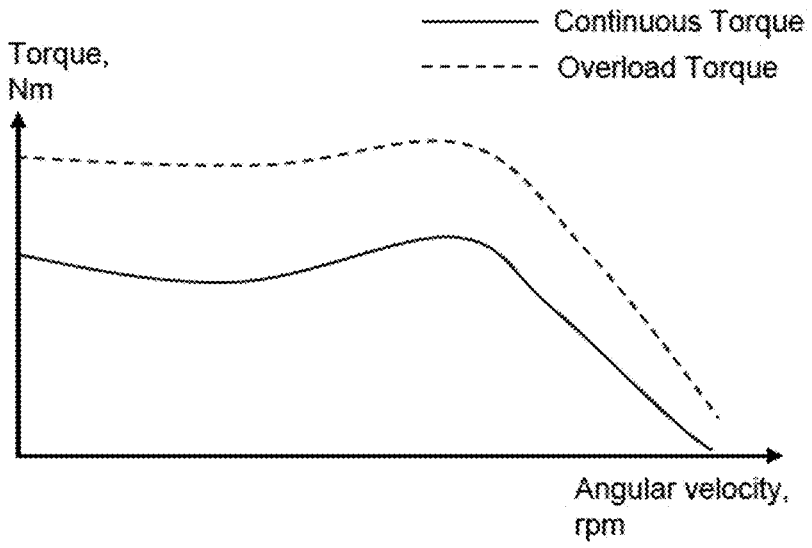
FIG. 2 is a graph the torque available to the variable frequency drive.

If a torque is applied and it is found that the retardation is not sufficiently rapid, the system is configured to apply a greater torque. It will be appreciated that the target guide path may be calculated based on using the maximum continuous torque available to reduce turn-around times. Therefore, the controller is, in this case, configured to allow the use of short-term overload torque for a limited period to allow the system to get back onto the glide path. Short-term torque is when the motor temporarily draws a current that if drawn continuously would lead to motor damage (e.g. through thermal effects). As shown in FIG. 2, this temporary higher current allows a higher overload torque to be applied for a given angular velocity than would be the case for the continuous torque curve.

If a torque is applied and it is found that the retardation is too rapid (e.g. if it continued, the quill would stop before the turn-around position), the controller is configured to apply a torque below the continuous torque curve and below the torque currently being applied. This allows the retardation rate to decrease (i.e. so that the quill slows down less rapidly) so that the retardation again matches the target glide path.

It will be appreciated that the machine learning is configured to ensure that the system responds in a way that reduces the time required to get the slow-down back to the glide path. In this way, the slow down is controlled on an ongoing basis.

It will be appreciated that monitoring and controlling the slow-down of the quill on an ongoing or continuous basis means that transient effects may automatically be taken into account. For example, if a torsional wave travels up through the drill string, the device can automatically adjust the amount of torque required to maintain the slow-down on the glide path and/or adjust the glide path itself in order to facilitate an orderly turn around. For example, if the inertia experienced is larger than expected, the set point for the velocity may be adjusted accordingly. This may allow for a more controlled oscillation turn-around.

In addition, the controller may be used to adapt the target glide path and/or when the slow down is initiated. For example, if the system is routinely using overload torque to meet the glide path or using less than maximum continuous torque, the controller may be configured to provide glide paths which correspond to using maximum continuous torque throughout the glide path.

In some embodiments, the system may be configured to limit the time for which overload torque can be used (e.g. within an oscillation cycle). For example, the device may be configured to use overload torque for a maximum of 3 seconds per oscillation cycle. If this is exceeded, the system may be configured to prevent further use of overload torque. This may result in the turn-around criteria not being met. In such circumstances, a warning may be provided to the user.

In some embodiments, the system may be configured to stop rotation if a threshold inertia is measured. I.e. if the drill string becomes too hard to rotate, the device may be configured to stop rotating in that direction and to turn around and initiate the next oscillation cycle. This may result in the turn-around criteria not being met. In such circumstances, a warning may be provided to the user.

Fuzzy Logic

The present system uses a proportional-integral-derivative controller (PID controller or three-term controller) which is a control loop mechanism employing feedback that is used in control systems and a variety of other applications requiring continuously modulated control. A PID controller continuously calculates an error value as the difference between a desired setpoint (SP) and a measured process variable (PV) and applies a correction based on proportional, integral, and derivative terms (denoted P, I, and D respectively).

In PID control, P works as an accelerator. The larger the error between setpoint and the current state of the system, higher the acceleration rate. The D gain works as a brake—the smaller the error larger the gain. The I gain is similar to a P gain but has a smaller effect. Assuming after P and D has brought the system very close to the setpoint and stop acting (steady state) but there is a minute error (steady state error), at this point I gain acts and bring the current state to the set point over time. This can be a slow process. In quill oscillator, the quill oscillates back and forth rapidly, and a small steady state error is acceptable (±1°), thus I gain may not used at all or left at a very small value.

Figure 3:
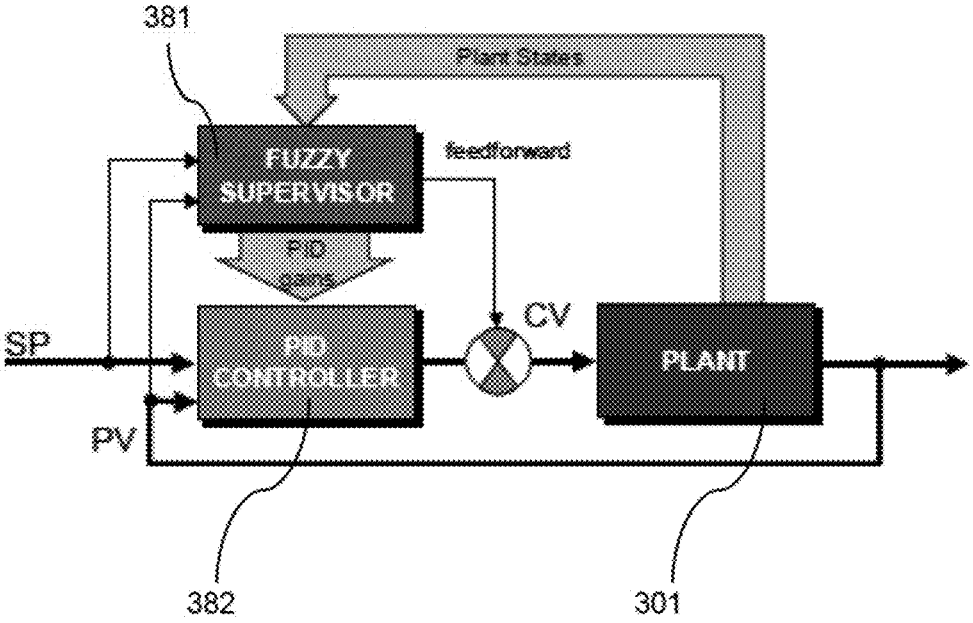
FIG. 3 is a schematic of the feedback loop.

In a typical control system, PID gains are fixed once the system is tuned and don't change on their own. The drawback of that is, if the system under control changes, the previously found P-I-D gains may not work that well. So every time the system changes (e.g. top drive gearbox wear and tear over time, drill sting weight changes thus increasing torque required to move the quill at a commanded speed etc.) the P-I-D loop needed to be retuned frequently for optimal performance and that cost time and money. The Fuzzy supervisor can look at the quill set point, current position, and how fast the quill is approaching the target position, can modify P and D gain on the fly without human intervention. That is, it is continually tuning the P-I-D loop. This may help save operating cost and archives accurate position control. FIG. 3 is a schematic of the feedback loop.

In this case, the controller comprises a PID controller and the system uses fuzzy gain scheduling for the PID control. The PID controller continuously calculates an error value e(t) as the difference between a desired setpoint (SP) and a measured process variable (PV) and applies a correction based on proportional, integral, and derivative terms (denoted P, I, and D respectively). In this embodiment, the integral term is ignored, and the correction is based on the proportional and derivative terms. In this case, fuzzy logic is used for position set point, angular velocity is considered to calculate current position of the quill in degrees.

The transfer function of a PID controller has the following form in the frequency s-domain:

$$G(s) = K_p + \frac{1}{s}K_i + K_d s$$

Where $K_p$, $K_i$ and $K_d$ are the proportional, integral and derivative gains and the discrete-time equivalent expression for the PID controller is:

$$u(k) = K_p e(k) + K_i T_s \sum_{i=1}^{n} e(i) + \frac{K_d}{T_s}\Delta e(k).$$

Here, u(k): control signal e(k): error between the reference and the process output $T_s$: Sampling period for the controller $$\Delta e(k)=e(k)-e(k-1)$$

Figure 4:
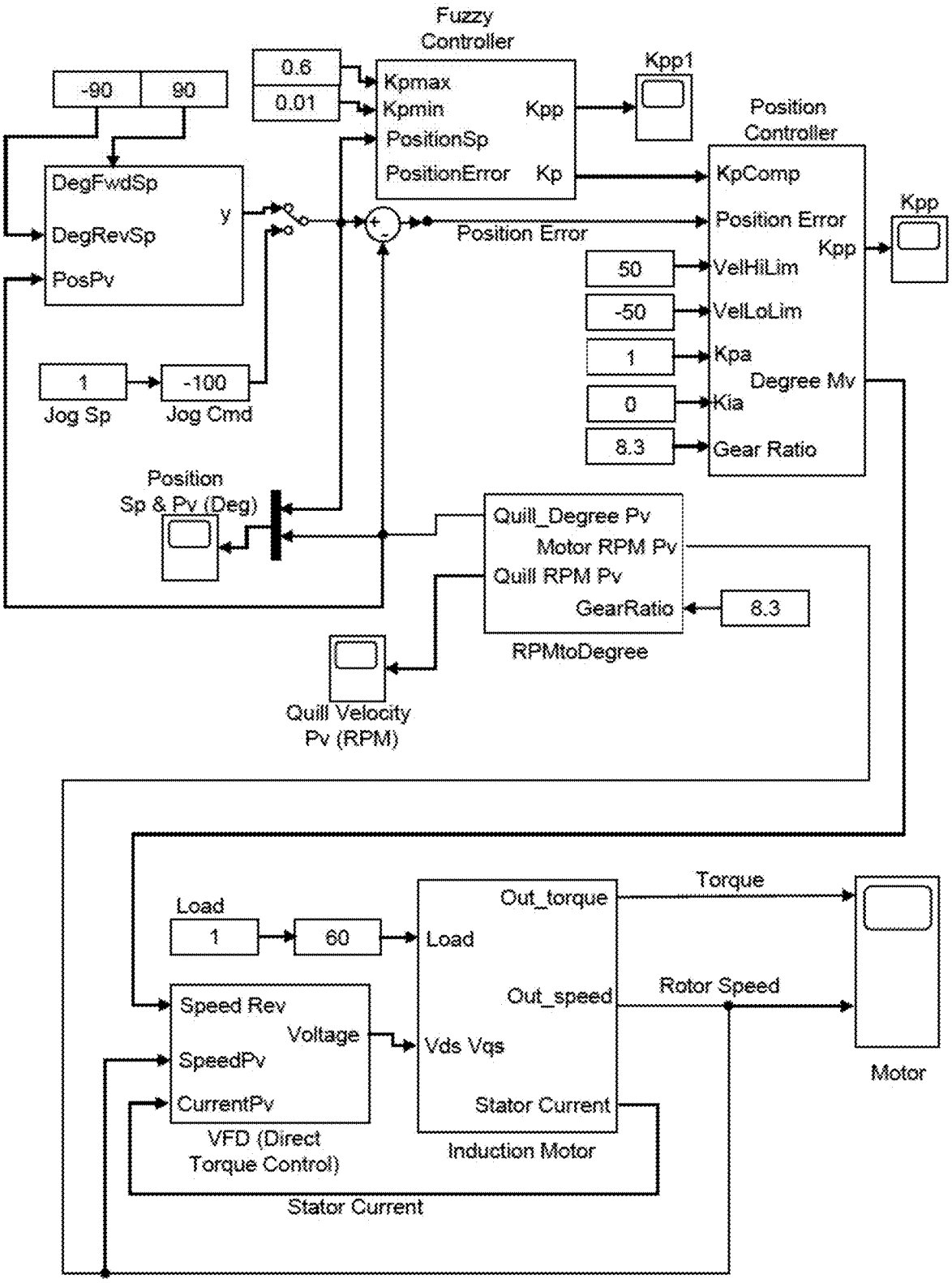
FIG. 4 is a schematic of the controller and how it interacts with the variable frequency drive and the motor.

FIG. 3 and FIG. 4 show the PID control system with fuzzy gain scheduler. The approach taken here is to exploit fuzzy rules and reasoning to generate controller parameters. The plant in this case comprises the variable frequency drive. The data from the plant 301 is fed into a fuzzy supervisor 381 which in turn is processed to provide information to the PID controller 382. The PID controller also receives set point, SP, data from an external source and the current process variable, PV, from the plant. The PID controller takes these inputs to calculate a control value, CV.

Tuning a control loop is the adjustment of its control parameters (proportional band/gain, integral gain/reset, derivative gain/rate) to the optimum values for the desired control response.

In this case, the proportional gain, integral gain and derivative gain may be configured to be within predetermined ranges. In this case, $K_p$ and $K_d$ are configured to be in prescribed ranges $[K_{p\,min}\ K_{p\,max}]$, $[K_{d\,min}\ K_{d\,max}]$, respectively. The appropriate ranges are determine based on extensive simulation study on various processes, a rule of thumb for determined the range of controller's gains as:

$$K_{p\,min}=0.32\,K_u \text{ and } K_p=0.6\,K_u$$

$$K_{d\,min}=0.008\,K_u\,T_u \text{ and } K_{d\,max}=0.15\,K_u\,T_u$$

where $K_u$ and $T_u$ are the gain and the period of oscillation at stability limit under P-controller of Ziegler-Nichols method.

The Ziegler-Nichols tuning method is a heuristic method of tuning a PID controller. It is performed by setting the I and D gains to zero. The P gain, $K_p$ is then increased (e.g. from zero) until it reaches the ultimate gain $K_u$, at which point the output of the control loop has stable and consistent oscillations. $K_u$ and the oscillation period $T_u$ are used to set the P, I, and D gains depending on the type of controller used.

For convenience, $K_p$ and $K_d$ are normalized into range between zero and one by following linear transformation:

$$K_{pp} = \frac{K_p - K_{p\,min}}{K_{p\,max} - K_{p\,min}}$$

$$K_{dd} = \frac{K_d - K_{d\,min}}{K_{d\,max} - K_{d\,min}}.$$

In the proposed scheme, PID parameter are determined based on the current error e(k) and its first derivative and because, in this case, the position controller is type II servo system and so the integral term may be neglected Once $K_{pp}$ and $K_{dd}$ are obtained, the PID controller parameters are calculated from the following equations:

$$K_p=(K_{p\,max}-K_{p\,min})K_{pp}+K_{p\,min}$$

$$K_d=(K_{d\,max}-K_{d\,min})K_{dd}\,K_{d\,min}$$

Fuzzification is the process of assigning the numerical input of a system to fuzzy sets with some degree of membership. This degree of membership may be anywhere within the interval [0,1]. If it is 0 then the value does not belong to the given fuzzy set, and if it is 1 then the value completely belongs within the fuzzy set. Any value between 0 and 1 represents the degree of uncertainty that the value belongs in the set. These fuzzy sets are typically described by words, and so by assigning the system input to fuzzy sets, we can reason with it in a linguistically natural manner.

The linguistic variables are as follows:

| | |
|---|---|
| NB | Negative Big |
| NM | Negative Medium |
| NS | Negative Small |
| ZO | Zero |
| PS | Positive Small |
| PM | Positive Medium |
| PB | Positive Big |

Figure 5:
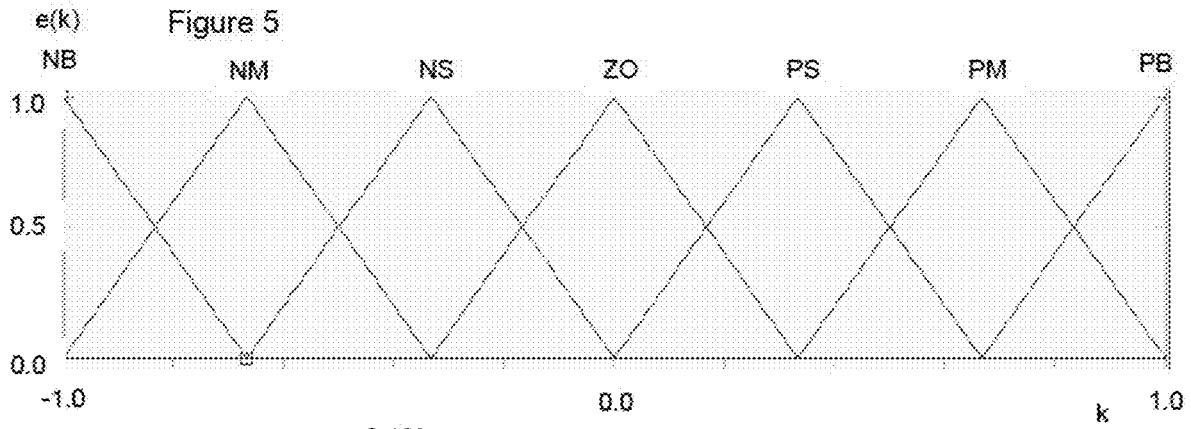
FIG. 5 is a graph of the fuzzy logic parameters.

Position error and the rate of change of position error are chosen to be the feedback signals. In this case, the position error is simply calculated as the difference between the target position set point and the current position. The rate of change of position error is calculated from how the position error is changing with time: i.e. the rate of change of position error=(Position error at t2−Position error at t1)/(t2−t1). This this is shown in FIG. 5.

Allocation to these linguistic variables are as follows:

$$NB = \begin{cases} 1 & e(k) \le 1 \\ -3 \cdot e(k) - 2 & 0 \le -3 \cdot e(k) - 2 \le 1 \end{cases}$$

$$NM = \begin{cases} 3 \cdot e(k) + 3 & 0 \le 3 \cdot e(k) + 3 \le 1 \\ -3 \cdot e(k) - 1 & 0 \le -3 \cdot e(k) - 1 \le 1 \end{cases}$$

$$NS = \begin{cases} 3 \cdot e(k) + 2 & 0 \le 3 \cdot e(k) + 2 \le 1 \\ -3 \cdot e(k) - 0 & 0 \le -3 \cdot e(k) - 0 \le 1 \end{cases}$$

$$ZO = \begin{cases} 3 \cdot e(k) + 1 & 0 \le 3 \cdot e(k) + 1 \le 1 \\ -3 \cdot e(k) + 1 & 0 \le -3 \cdot e(k) + 1 \le 1 \end{cases}$$

$$PS = \begin{cases} 3 \cdot e(k) & 0 \le 3 \cdot e(k) \le 1 \\ -3 \cdot e(k) + 2 & 0 \le -3 \cdot e(k) + 2 \le 1 \end{cases}$$

$$PM = \begin{cases} 3 \cdot e(k) - 1 & 0 \le 3 \cdot e(k) - 1 \le 1 \\ -3 \cdot e(k) + 3 & 0 \le -3 \cdot e(k) - 1 \le 1 \end{cases}$$

$$PB = \begin{cases} 3 \cdot e(k) - 2 & 0 \le -3 \cdot e(k) - 3 \le 1 \\ 1 & e(k) - 1 \le 1 \end{cases}$$

Figure 6A:
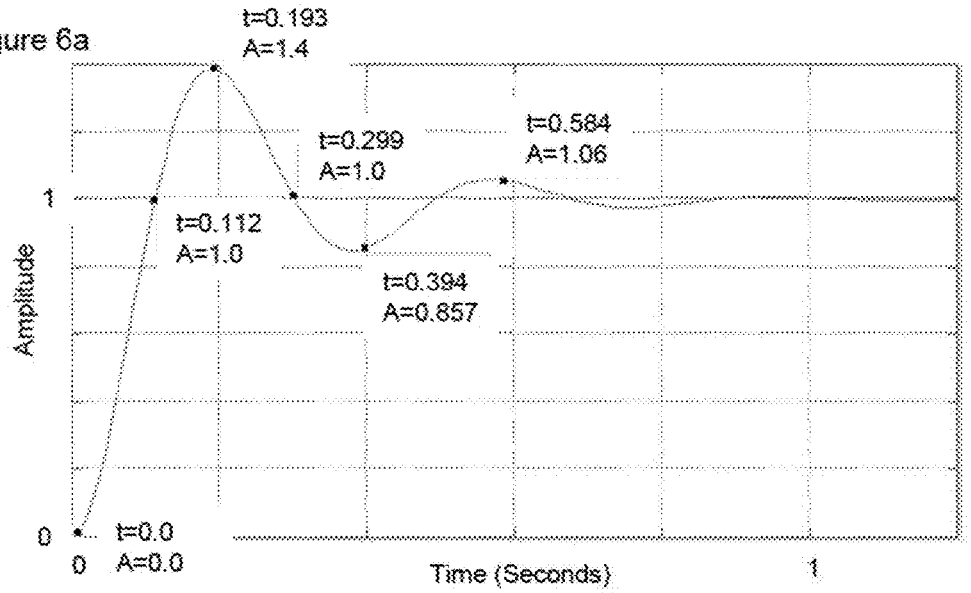
FIG. 6*a* is a graph of a desired time response.
Figure 6B:
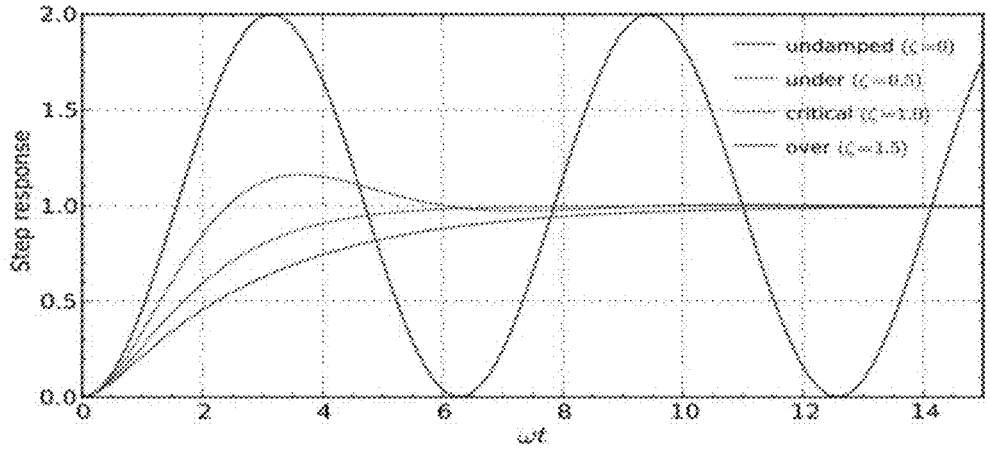
FIG. 6*b* is a graph of undamped, underdamped, overdamped and critically damped responses.

The Fuzzy Rules experimentally based on the step response of the second order process. FIG. 6*a* shows an example of a desired time response. In FIG. 6*a*, what we see is the P gain is big enough to bring the system to amplitude 0.997 from 0.0123 in around 0.1 sec, thus the risetime is acceptable. Now, because of inertia of the system slight oscillation is observed but the system settles down within 2 cycles and not over long time (i.e. not having many peaks and troughs or taking a long time to settle near setpoint). If we consider a case where the P gain is quite small compare to what is used in FIG. 6*a*, we may not see any overshoot at all but instead off 0.1 sec rise time we might have seen a much longer rise time. That would be called critically damped or overdamped system (see the FIG. 6*b*). The result depends on what response is expected from a system, for quill oscillator a shorter rise time is expected.

At around 0.112 seconds in FIG. 6*a*, a small controller gain is used to avoid a large overshoot. That is, the PID controller should have small proportional gain, a large derivative gain and a smaller integral gain.

Thus a set of rules as show in table 1 is used to adapt the proportional gain $K_{pp}$

TABLE 1

Fuzzy Rules

| | | Δe(k) | | | | | | |
|---|---|---|---|---|---|---|---|---|
| | | NB | NM | NS | ZO | PS | PM | PB |
| e(k) | NB | B | B | B | B | B | B | B |
| | NM | S | B | B | B | B | B | S |
| | NS | S | S | B | B | B | S | S |
| | ZO | S | S | S | B | S | S | S |
| | PS | S | S | B | B | B | S | S |
| | PM | S | B | B | B | B | B | S |
| | PB | B | B | B | B | B | B | B |

The table above is read out as:

If e(k) is NegativeBig (NB) and Δe(k) is NegativeBig (NB) Then Kpp is Big (B) set If e(k) is NegativeMedium (NM) and Δe(k) is NegativeBig (NB) Then Kpp is Small (S) set

. . .

Figure 7:
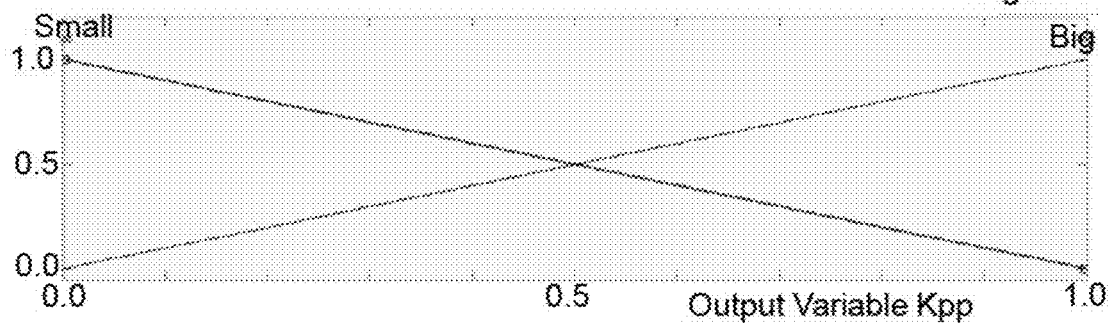
FIG. 7 is a graph showing the defuzzification method.

If e(k) is PositiveBig (PB) and Δe(k) is NegativeBig (NB) Then Kpp is Big (B) set Defuzzification is the process of producing a quantifiable result in standard logic, given fuzzy sets and corresponding membership degrees. It is the process that maps a fuzzy set to a standard logic set. It is typically needed in fuzzy control systems. These will have a number of rules that transform a number of variables into a fuzzy result, that is, the result is described in terms of membership in fuzzy sets. Defuzzification is interpreting the membership degrees of the fuzzy sets into a specific decision or real value. In this case, as shown in FIG. 7, the centroid method is used to compute the fuzzy output: $\mu_x$ is fuzzy input, once position error, and rate of change of position error is calculated, they are normalized to bring to a scale of 0-±1 and those values are used as fuzzy input. The Z is the output of the fuzzy controller after defuzzification which is Kpp, and Kdd. Then the equations described above is used to calculate final output Kp and Kd. The $\mu_x(Z)$ represents Z-shaped membership function is used. The z (lower case) is the fuzzy grade obtained during fuzzification. In fuzzy logic theory, there are S, Z, A, and π shaped membership function available.

$$Z = \frac{\int \mu_x(z) \cdot z dz}{\int \mu_x(z) dz}$$

Set Big:

Triangle Area=$\frac{1}{2}\mu_x^2$

Triangle Centroid=$\int_0^{\mu_x} \mu_x z dz = \frac{1}{3}\mu_x^3$

Rectangle Area=$\mu_x - \mu_x^2$

Rectangle Centroid=$\int_{\mu_x}^{1} \mu_x z dz = \frac{1}{2}\mu_x - \frac{1}{2}\mu_x^3$ Set Small:

Triangle Area=$\mu_x - \mu_x^2$

Triangle Centroid=$\int_0^{1-\mu_x} \mu_x z dz = \frac{1}{2}\mu_x^3 + \frac{1}{2}\mu_x - \mu_x^2$ Rectangle Area=$\mu_x - \mu_x^2$ By using fuzzy logic and PID controllers in this way, the system can be configured to meet the turn-around criteria quickly without overshooting.

Operational Data

Figure 8A:
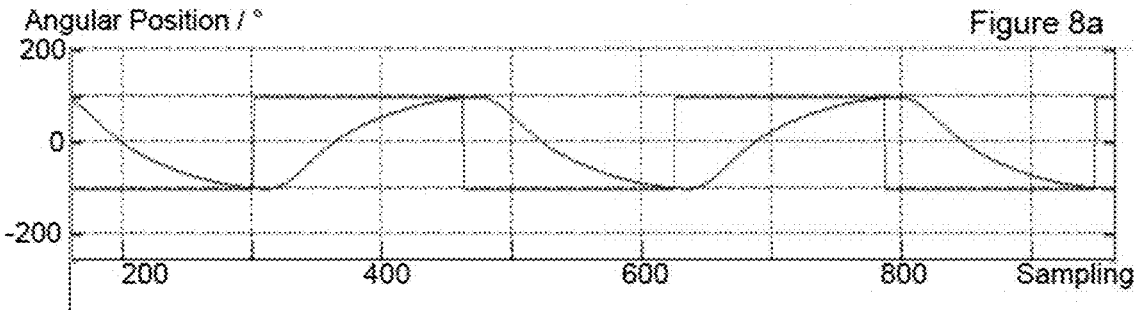
FIGS. 8*a-c* are graphs of experimental data associated with a series of oscillations.
Figure 8B:
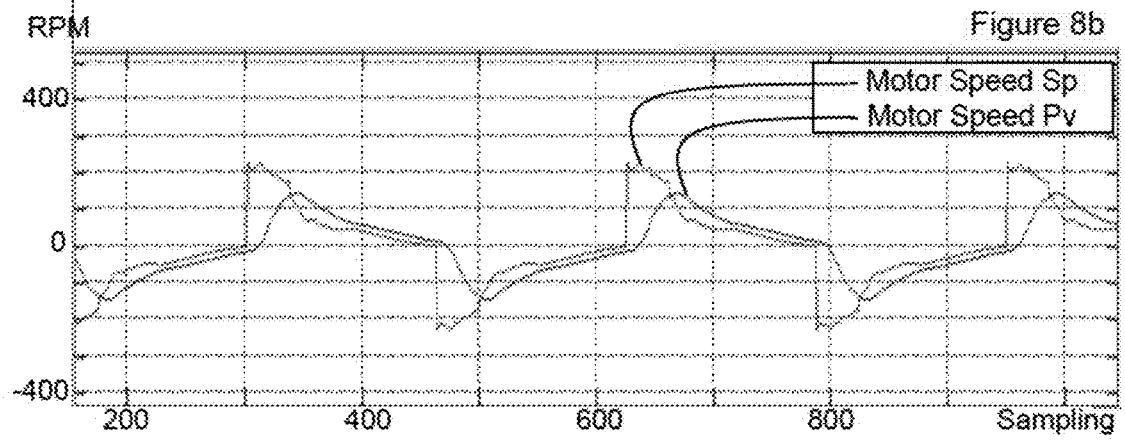
Figure 8C:
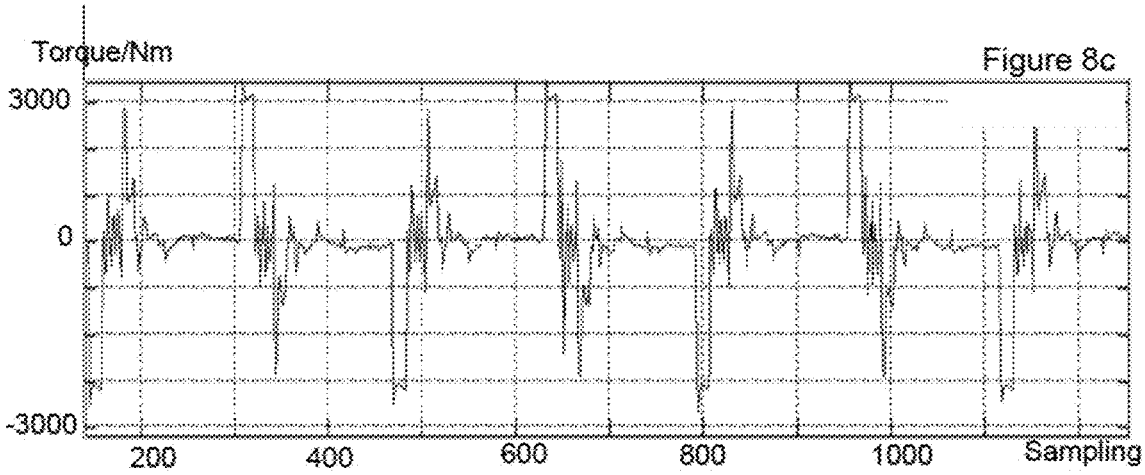

FIGS. 8*a-c* are graphs of experimental data associated with a series of oscillations. FIG. 8*a* shows the angular position set points and recorded values. in this case, the angular position set point is configured to switch between 100° in the clockwise direction and 100° in the anticlockwise direction. In this case, the angular position setpoint switches between the two set-points which may be set by the operator or by another external algorithm (e.g. calculated to maintain toolface orientation during repeated oscillations).

FIG. 8*b* shows the angular velocity set point and measured values. FIG. 8*c* is a graph of the torque exerted on the variable frequency drive by the drill string. In other words, it is a measure of the inertia of the drill string as experienced by the variable frequency drive.

When the system has met the position set point, the set point is switched. In response to this switch, a new angular velocity set point is applied. In this case, the new set point is around 200 rpm. This value may be set externally by a user or by another algorithm. In order to meet this set point, the variable frequency drive responds to meet this set point, but it experiences inertia applied by the drill string. In response to the inertia applied by the drill string, the controller is configured to adjust the angular velocity set point. In this case, the inertia is high, and the system responds by lowering the angular velocity set point. However, the angular velocity set point is still above the measured velocity, so the system continues to apply an accelerating torque.

At a certain point, the measured velocity meets and then exceeds the set point curve. At this stage, the system reacts to stop accelerating. Around this point, the inertia of the drill string acts in the opposite direction. In response, the controller is configured decrease the angular velocity set point less rapidly. This allows the angular velocity set point and measured value to decrease in tandem until the angular position set point is met.

Figure 9:
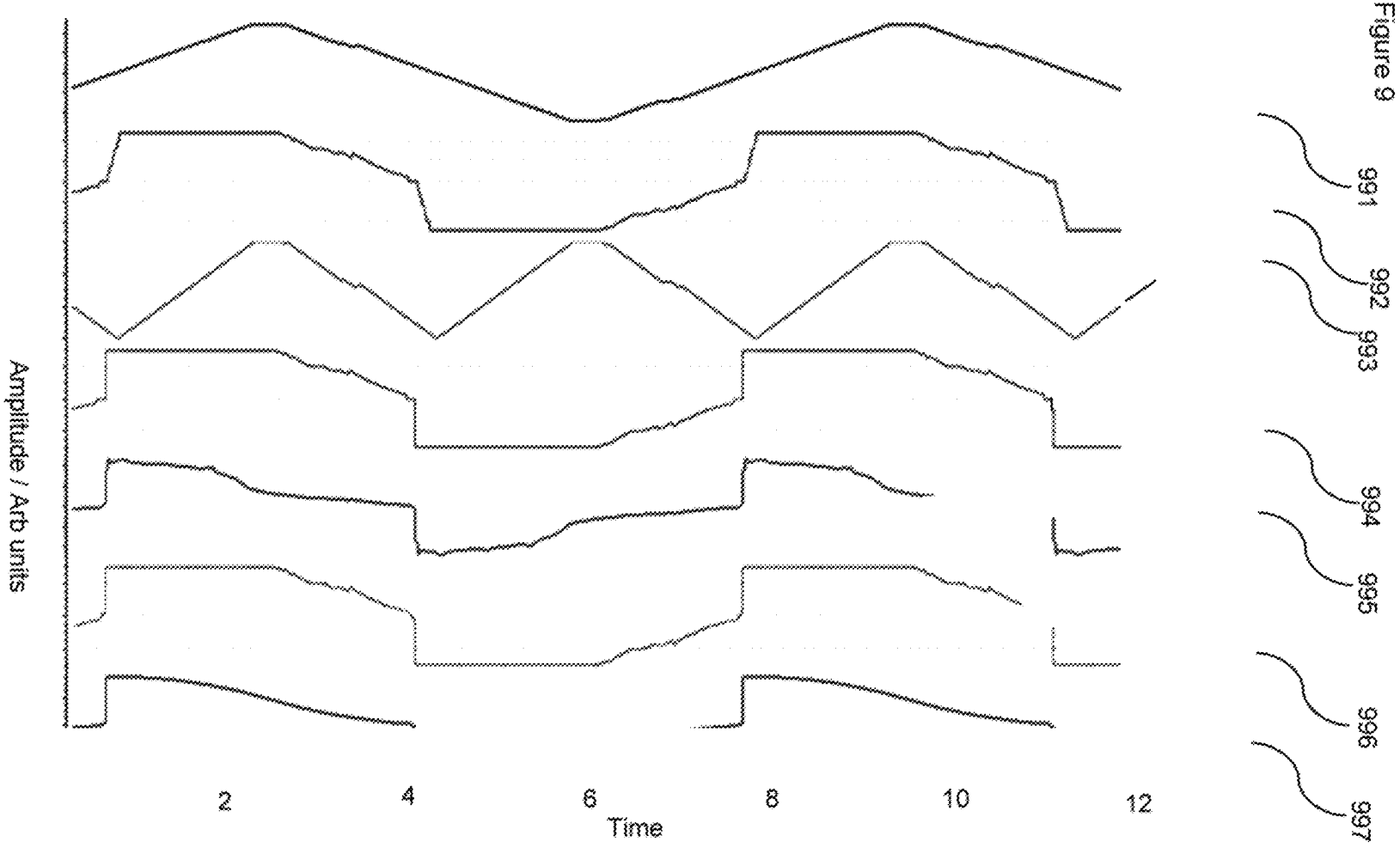
FIG. 9 is a series of graphs of experimental data associated with a series of oscillations.

FIG. 9 is a series of graphs of experimental data associated with a series of oscillations. Here are the traces to show how Fuzzy logic is calculating P gain dynamically based on the position error.

In FIG. 9:

- trace 991 (from the top) shows variable frequency drive feedback of the motor rpm,
- trace 992 shows the motor speed command sent to the variable frequency drive from controller,
- trace 993 shows the quill speed feedback (there is a gear ratio of 8.5 between motor and quill, the motor rpm is 8.5 times higher than the quill),
- trace 994 shows the quill velocity command which is identical to motor velocity command (the quill speed command is originally computed and then scale up by gear ratio and sent to variable frequency drive as a motor speed command),
- trace 995 shows the P gain calculated by fuzzy controller which is based on the position error (trace 997), and
- trace 996 is the combined value of P+I+D and represented as M.

The effect of fuzzy logic in this way was tested for a quill oscillator is set to rotate at 30 rpm 180° forward and reverse. In this case, using fuzzy logic, the quill reached forward turn around at 178 degrees which is just 2 degree undershot from 180 (compared to a 35-degree overshot without using fuzzy logic). Using fuzzy logic, the quill reached reverse turn around at −176 degrees which is just 4 degree undershot from −180 compared to a −33 degree overshot without fuzzy logic. This demonstrates a better position control over a traditional P-I-D controller.

Other Options

The system may comprise a gearbox between the drive and the drill string. The gearbox may have a ratio of between 7:1 and 10:1. The input speed may be between 1500-2000 rpm. The output torque may be between 25 and 50 Nm. The input power may be between 0.5 and 2 hp (0.4-1.5 kVV).

It will be appreciated that the backlash of the gearbox on the top drive may have major impact on the overall system performance, and it will be different from rig to rig. The gearbox condition will also affect the system's performance as well. This means that using machine learning may be more advantageous than using a deterministic model of the system because the machine learning will automatically take into account differences in top drive and transmission (e.g. between the gearbox and quill) behaviours.

The variable frequency drive may have the following characteristics:

Input: 3 Phase 48-63 Hz
Input Voltage (U1): 380-500 Vac
Input Current (I1n): 4.7 Amps
Output: 3 Phase 0-300 Hz
Output Voltage (U2): 0-U1 $V_{ac}$
Output Current (I2n): 4.9 Amps
Power (Pn): 3 hp The drilling components described above may also be used in conventional rotation drilling.

The Machine Learning algorithms may be configured to calculate a cost function based on an integrated measure of the minimum distance to the target glide curve over the course of the slow-down. The cost function can be used to give an indication in a particular oscillation of how well the system is performing.

In some embodiments, the system may be configured to assign a Turn Around Success Value, σ, to each turn around.

It will be appreciated that the system may be configured to be biased towards under-rotating the quill. This is because if the quill is under-rotated, friction is slightly higher than optimal but the toolface of the drillbit is not disturbed. In contrast, if the quill is over-rotated, the drillbit will be moved and the shape of the well may be irreversibly changed.

The system may be configured to use Machine Learning.

The Machine Learning feeds an optimizer and set points for the top drive are reported. The set points define the settings to control the top drive to reduce the ramp-down and to meet the turn-around criteria. The optimizer may use differential evolution, Ant colony optimization and/or Gradient descent.

Machine learning removes the need for lengthy calculation. Machine learning algorithms may mitigate the need for estimates or calculations. Therefore, they can be applied in real time (e.g. every millisecond).

It will be appreciated that the machine learning is configured to base its determination on associating: calculated or sensor-measured system parameters; output parameters (e.g. measured turn-around parameters); and input parameters (e.g. topdrive parameters). The Machine Learning may be configured to predict the output parameters for a particular configuration of input parameters.

In some embodiments, the system may be configured to explore a particular subset of input parameters to record the system response in order to better learn the system characteristics. For example, the system may be configured to determine a range of input conditions which provides a predicted turn-around angular position of no more than 1° from the turn around criteria. The system may be configured to vary the input within this subset of possible input conditions in order to determine whether there are better configurations than the predicted optimum input conditions. This may help the learning algorithm better categorise the system. It may also allow the Machine Learning algorithm to adapt to changes in the system. If discrepancies between the predicted and actual outputs are found, the system may be configured to repeat the steps of predicting the output based on the updated information received from the system.

In some embodiments, the system may be configured to use discrepancies between the predicted and actual outputs to determine whether faults have occurred. For example, if there were a failure in one of the components, the discrepancy between the predicted and actual outputs may be used to alert the operator.

It will be appreciated that during a drilling operation, the friction on the drill string may increase monotonically as the drilling continues. Therefore, the quill rotation differential, $\Delta\theta$, of previous oscillation cycles may be provided to the machine learning algorithm (e.g. in an ordered series) as an input. In this way, for example, if the previous quill rotation differential showed a trend upwards (i.e. the over-rotation of the quill was getting bigger with each successive oscillation), the machine learning may be configured to compensate by starting the ramp-down earlier. By providing the quill rotation differential, $\Delta\theta$, of previous oscillation cycles to the controller as an input, the machine learning may be configured to make this adjustment more quickly.

In this way, the controller is configured to enable control of the variable frequency drive based on the received information and on previous behaviour of the system to meet predetermined oscillation turn-around criteria.

In this case, historical data may be transferred to a data warehouse or other processing facility or be processed on-site. The following parameters are input into the system: the torque applied to the quill by the drill string, the angular position of the quill and the turn-around criteria. In some embodiments the angular position of the quill is calculated, in others it is measured. Other embodiments may use the angular velocity, angular acceleration, and/or angular jerk of the quill (these parameters may be calculated or measured).

Historical data (detailed above) is used to train the algorithms, and then more operational data is used over time to continue to refine the algorithm (e.g. online learning) and to reflect changes in the operational parameters of the system (e.g. membrane and/or pump degradation). Providing angular velocity, angular acceleration, and/or angular jerk of the quill are important in some embodiments to provide a more effective the model. That is, the Machine Learning may be able to determine the best approach more quickly when one or more of these parameters are provided directly to the Machine Learning algorithm.

Although the present invention has been described and illustrated with respect to preferred embodiments and preferred uses thereof, it is not to be so limited since modifications and changes can be made therein which are within the full, intended scope of the invention as understood by those skilled in the art.

The invention claimed is:

1. A drilling system for oscillating a drill string having a fluid-driven drill stage, the drilling system comprising:

a top drive comprising a variable frequency drive configured to repeatedly oscillate the drill string via a quill during slide drilling, wherein each oscillation of the drill string includes a clockwise oscillation cycle and a counter-clockwise oscillation cycle;

a sensor array having a sensor configured to determine a measure of torque applied to the quill;

a controller configured to receive information from the sensor array and to determine the angular position and speed of the quill and the inertia applied to the quill by the drill string, wherein the controller is configured to enable ongoing control of the variable frequency drive while decreasing the angular velocity of the quill from a maximum rotational speed to zero in an oscillation cycle, the zero rotational speed corresponding to a turn-around point in the oscillation where the variable drive stops rotating in one direction and starts rotating in the opposite direction;

the ongoing control comprising adaptively adjusting control parameters of the variable drive in real time in response to the determined applied inertia and the angular position and speed of the quill, and being configured to reduce the time to decrease the angular velocity of the quill from the maximum rotational speed to zero in the oscillation cycle and to meet predetermined oscillation turn-around criteria.

2. The system according to claim 1, wherein the fluid-flow driven drill stage comprises a mud motor.

3. The system according to claim 1, wherein the sensor array comprises an angular position sensor configured to measure the angular position of the quill.

4. The system according to claim 1, wherein the system is configured to calculate the angular position from a motor angular speed reported by the variable frequency drive.

5. The system according to claim 1, wherein the oscillation turn-around criteria comprise an angular position at which the quill stops rotating in one direction and starts rotating in the opposite direction.

6. The system according to claim 1, wherein the system is configured to meet an angular-position oscillation turn-around criteria to within plus or minus 5 degrees.

7. The system according to claim 1, wherein the oscillation turn-around criteria comprise a torque at which the quill stops rotating in one direction and starts rotating in the opposite direction.

8. The system according to claim 1, wherein the controller is configured to initiate slow-down based on the measured speed of the quill, the measured inertia and the rotational position of the quill.

9. The system according to claim 1, wherein the controller is configured to continuously control the torque being applied to the quill by the variable frequency drive to follow a target glide path, the target glide path being configured to meet the predetermined turn-around criteria, and wherein the glide path is calculated based on the torque applied to the quill by drill string.

10. The system according to claim 1, wherein the controller is configured to allow short-term overload torque to be applied in response to the controller detecting that the quill is not being slowed down sufficiently quickly to meet the turn-around criteria.

11. The system according to claim 1, wherein the controller is configured to allow less than a maximum continuous torque to be applied in response to the controller detecting that the quill is being slowed down too quickly to meet the turn-around criteria.

12. The system according to claim 1, wherein the controller is configured to prevent short-term overload torque being used for more than a threshold period of time within an oscillation cycle.

13. The system according to claim 1, wherein the controller is configured to stop rotation if a threshold inertia is measured regardless of whether the turn-around criteria is met.

14. The system according to claim 1, wherein the controller comprises a PD controller.

15. The system according to any claim 1, wherein the controller comprises a PID controller.

16. The system according to claim 1, wherein the ongoing control comprises automatically modifying angular position proportional gain and derivative-gain values.

17. The system according to claim 1, wherein the controller comprises a fuzzy logic module configured to process feedback from the variable frequency drive, wherein the fuzzy logic module is configured to control the variable frequency drive based on a quill target position set point, a current quill position, and how fast the quill is approaching the quill target position set point.

18. The system according to claim 1, wherein the ongoing control is based on monitoring feedback variables associated with the quill, the feedback variables comprising:

angular position error; and rate of change of angular position error.

19. The system according to claim 1, wherein the sensor is configured to determine a measure of torque indirectly based on measuring the current consumed by a motor of the variable frequency drive.

20. A method of controlling a drilling system, the drilling system comprising:

a drill string comprising a fluid-driven drill stage;

a top drive comprising a variable frequency drive configured to repeatedly oscillate the drill string via a quill during slide drilling, wherein each oscillation of the drill string includes a clockwise oscillation cycle and a counter-clockwise oscillation cycle;

a sensor array having a sensor configured to determine a measure of torque applied to the quill;

a controller configured to receive information from the sensor array and to determine the applied torque, and the angular position and the angular speed of the quill, wherein the method comprises:

controlling the variable frequency drive during slide drilling on an ongoing basis while decreasing the angular velocity of the quill from a maximum rotational speed to zero in an oscillation cycle, the zero rotational speed corresponding to a turn-around point in the oscillation cycle where the variable drive stops rotating in one direction and starts rotating in the opposite direction;

the ongoing control comprising adaptively adjusting control parameters of the variable drive in real time in response to a determined applied inertia and the angular position and speed of the quill and being configured to reduce the time to decrease the angular velocity of the quill from the maximum rotational speed to zero in the oscillation cycle and to meet predetermined oscillation turn-around criteria.

* * * * *